US006854169B2

(12) United States Patent
Love, III et al.

(10) Patent No.: US 6,854,169 B2
(45) Date of Patent: Feb. 15, 2005

(54) METHOD FOR THE DESCALING OF METAL

(75) Inventors: Franklin Sadler Love, III, Columbus, NC (US); Derek Scott Kozlowski, Spartanburg, SC (US)

(73) Assignee: Sadler Love & Associates, Inc., Columbus, NC (US)

( * ) Notice: Subject to any disclaimer, the term of this patent is extended or adjusted under 35 U.S.C. 154(b) by 123 days.

(21) Appl. No.: 09/783,353

(22) Filed: Feb. 14, 2001

(65) Prior Publication Data

US 2001/0047576 A1 Dec. 6, 2001

Related U.S. Application Data

(60) Provisional application No. 60/182,327, filed on Feb. 14, 2000.

(51) Int. Cl.[7] ..... B21B 45/04

(52) U.S. Cl. ..... 29/81.06; 29/81.01

(58) Field of Search ..... 29/81.06, 81.01, 29/81.03, 81.08, 81.09, 81.12, 81.13; 451/38.75, 89.95; 51/293; 92/38, 40, 53

(56) References Cited

U.S. PATENT DOCUMENTS

| | | | | |
|---|---|---|---|---|
| 2,059,915 A | | 11/1936 | Ruch | |
| 2,434,881 A | | 1/1948 | Dill | |
| 2,796,338 A | | 6/1957 | Haberl | |
| 3,073,022 A | | 1/1963 | Bush et al. | |
| 3,188,776 A | | 6/1965 | Dill | |
| 3,320,701 A | | 5/1967 | Abrams et al. | |
| 4,195,450 A | * | 4/1980 | Korb et al. | 451/38 |
| 4,250,726 A | * | 2/1981 | Safian et al. | 72/38 |
| 4,287,740 A | | 9/1981 | Kumar | |
| 4,872,294 A | | 10/1989 | Watts | |
| 4,877,638 A | * | 10/1989 | Novak et al. | 427/8 |

FOREIGN PATENT DOCUMENTS

| | | |
|---|---|---|
| DE | 28 37 030 A1 | 6/1980 |
| DE | 196 36 801 A1 | 2/1998 |
| EP | 0 710 511 A1 | 8/1995 |
| GB | 736253 | 9/1955 |
| GB | 1 507 546 | 4/1978 |
| GB | 2 023 038 | 12/1979 |
| GB | 2 023 469 | 1/1980 |
| WO | WO 00/59683 A1 | 10/2000 |

OTHER PUBLICATIONS

BrightBlast Glass Beads; Pan Abrasives Group; SB2011.
CeraPeen Ceramic Beads; Pan Abrasives Group; SB2003.
Blast Pattern Must Be Focused Correctly; Pan Abrasive Inc.; p. 3.
Blast Off 2—Your Guide to Safe And Efficient Abrasive Blasting; Clemco Industries Corp.; p. 76.
Copy of International Search Report for PCT/US01/04717, completed Jun. 27, 2001.

(List continued on next page.)

*Primary Examiner*—John C. Hong
(74) *Attorney, Agent, or Firm*—Kennedy Covington Lobdell & Hickman, LLP

(57) ABSTRACT

A method and apparatus for the descaling of metal surfaces without the use of caustic substances is provided. The apparatus includes a first and second blast heads containing fan shaped nozzles that spray high velocity jets of smooth edged, ceramic media at a scale covered continuous sheet of steel. The continuous sheet of steel is advanced into an abrading station containing a pair of brush assemblies that include stainless steel bristled brushes. The stainless steel brushes engage the surface of the sheet of steel and abrade away the cracked scale, leaving a surface clean of scale. The surface produced is pH neutral and therefore resists additional corrosion and does not require oil coatings, or other protective treatments. The metal surface is produced with a roughness that is less than 2.5 microns Ra without stretching, polishing, cold-rolling or the use of acid pickling. Eliminating these steps makes for a faster, more robust process and saves considerable cost.

28 Claims, 5 Drawing Sheets

U.S. PATENT DOCUMENTS

| | | | | | |
|---|---|---|---|---|---|
| RE34,854 | E | | 2/1995 | Shank, Jr. | |
| 5,441,763 | A | | 8/1995 | Kuo | |
| 5,554,235 | A | | 9/1996 | Noe et al. | |
| 5,591,064 | A | | 1/1997 | Spears, Jr. | |
| 5,736,709 | A | | 4/1998 | Neiheisel | |
| 6,088,895 | A | * | 7/2000 | Nelson et al. | 29/81.01 |
| 6,126,516 | A | * | 10/2000 | Barrier et al. | 451/38 |
| 6,478,662 | B1 | * | 11/2002 | Krejcik | 451/75 |

* cited by examiner 10
13
17
19
20
21
23
24
25
26
27
28
29
45
60
62
70

METHOD FOR THE DESCALING OF METAL

CROSS-REFERENCE TO RELATED APPLICATIONS

Priority is claimed to provisional application No. 60/182,327 entitled "Non-acid Descaling of Metal" filed on Feb. 14, 2000 now abandoned.

FIELD OF THE INVENTION

The present invention relates to a method and apparatus to the production and finishing of metal surfaces, more particularly to the removal of scale from the metal surfaces, e.g., surfaces of metal sheet.

BACKGROUND OF THE INVENTION

Hot rolled steel, stainless steel and other metals are currently descaled by a process called pickling. Pickling involves advancing the steel through long acid baths that remove the oxide layers that form scale. Most carbon steel strip is pickled in hydrochloric acid tanks at strip speeds of about 400 to 1000 feet per minute. It is more difficult to remove scale from stainless steel and the descaling process requires stronger acids such as, hydrofluoric, sulfuric, or nitric acid. Pickling of stainless steel also requires longer times in the acid tank which reduces the line speeds for stainless steel strip down to about 100 to 400 feet per minute. The disposal of byproducts resulting from the pickling process is hazardous, as well as costly, as the byproducts are considered to be toxic pollutants.

Conducting the pickling process can also be problematic. Line stops, where the metal strip is stopped in the acid for an extended period of time, often result in overpickling. Overpickling may damage the surface of the metal strip. Different types of metals require varying acid mixtures for optimum pickling. If the same line is being used for multiple types of metal, line stops and changeover time are incurred when the acid mixture is changed. Pickled metal is left with a low pH (less than 7) causing the metal to reoxidize unless protected from oxygen by a layer of oil. The oil is expensive to apply and must be removed for certain downstream processing steps such as painting or coating.

Descaling of metal surfaces can also be performed using two common blasting techniques. A first blasting technique uses relatively large particle shot at low velocities to assist in acid descaling. A second technique descales with a jet of sharp edged abrasive media such as sand, silicon carbide, aluminum oxide, or steel grit. Abrasive jet descaling is somewhat inefficient for two reasons. Continuous descaling of metals, particularly carbon and stainless steel, with abrasive media having sharp edges causes the media to embed itself into the steel surface. Therefore, heavy coverage with the abrasive media is needed to completely clean off the oxide layers. In addition, the embedded sharp edged media must be removed in what is typically a costly and difficult abrading step.

U.S. Pat. No. 6,088,895 to Nelson et al. discloses a method for descaling hot rolled strip that uses shot blasting in conjunction with tension leveling, brush cleaning and brush polishing. In particular, this patent discloses stretching the strip in tension to at least 1% elongation to level the strip and induce cracking in the scale covering the strip, shot blasting using metallic particles propelled from a blasting wheel to ablatively remove a portion of the scale, mechanically removing additional scale to using two pairs of counter-rotating wire brushes until the metal sheet reaches a surface roughness of 3.6 micron Ra, and polishing the strip with another pair of brushes to reduce the roughness to within a range of about 2.0 micron Ra.

It would be advantageous to have a high-speed, rugged mechanical method and apparatus for cleaning scale from metal surfaces that avoids the problems of acid pickling. More particularly, it would be advantageous the have a descaling method and apparatus that requires minimal steps to produce a relatively smooth surface that has been thoroughly cleaned of scale. It would be further advantageous if the surface was resistant to formation of scale after descaling.

SUMMARY OF THE INVENTION

An apparatus and method for the descaling of metal surfaces without the use of acids, or other caustic materials, is disclosed. Caustic materials include acids, bases or any other type of material that is toxic, dangerous or otherwise environmentally undesirable. The present invention is particularly useful for descaling metal surfaces such as those found on hot rolled steel, stainless steel and nonferrous metal strip, bar, rod, and wire. The method includes a high intensity, high velocity stream of small and smooth particles propelled at a steel surface, followed by mechanical abrading of the surface.

In a first preferred embodiment, the present invention includes a descaling apparatus for the continuous descaling of an advancing metal surface without the use of caustic materials. A blast head having a blast nozzle is in fluid communication with a supply of media under a fluid pressure. The blast nozzle is positioned in proximity to the advancing metal surface and sprays the media onto at least a portion of the advancing metal surface. An abrading device abrades the portion of the metal surface sprayed with the media by the blast nozzle. The abrading device and blast head cooperate to descale the portion of the advancing metal surface.

In a second preferred embodiment, the present invention includes a blast head for loosening scale on a metal surface using smooth edged media. A chamber defines an inlet and an outlet. The inlet is sized for the metal surface to pass therethrough into the chamber and the outlet is sized and positioned relative to the inlet for the metal surface to pass therethrough and out of the chamber. At least one nozzle having an inlet and a fan shaped outlet is in fluid communication with a supply of smooth edged media under a fluid pressure. The fan shaped outlet is positioned in the chamber and in proximity to the metal surface. A deceleration zone is positioned in the chamber and on an opposite side of the chamber from the fan shaped outlet. A media outflow zone is positioned at a bottom of the chamber whereby the smooth edged media is propelled by the fluid pressure through the nozzle and out of the fan shaped outlet in a fan shaped spray onto the metal surface such that the spray loosens the scale on the metal surface. The deceleration zone decelerates any errant media missing the metal surface, limiting damage to the blast head. The media outflow zone captures any falling media. A recycle line recycles the media from the media outflow zone to a recovery apparatus. The recovery apparatus recovers media that is still usable and delivers the recovered media back to the supply of media.

In a third preferred embodiment, the present invention includes a descaling apparatus for removing a layer of scale from a continuous sheet of metal having a top and bottom surfaces. The descaling apparatus includes a conveyor for conveying the continuous sheet of metal along a predetermined path. A pressure pot contains a supply of media which it distributes through a plurality of supply lines using a fluid pressure, such as air pressure.

In the third preferred embodiment, the descaling apparatus can include first and second blast heads. The first blast head has a plurality of down-firing blast nozzles. Each of the blast nozzles is coupled to one of the supply lines to receive media under a fluid pressure. The blast head is positioned in proximity to the predetermined path of the continuous metal sheet. The blast heads use the air pressure to distribute the media in a down-firing spray. The down-firing spray of media cracks a portion of the layer of scale on the top surface of the continuous sheet.

The second blast head used in the third preferred embodiment has a plurality of up-firing blast nozzles, each of the blast nozzles coupled to one of the supply lines to receive media under a fluid pressure. The second blast head is also positioned in close proximity to the predetermined path of the continuous metal sheet and uses the fluid pressure to distribute the media in an up-firing spray. The up-firing spray of media cracks a portion of the layer of scale on the bottom surface of the continuous metal sheet.

An abrading station is also provided in the third preferred embodiment having a plurality of brushes. The abrading station is positioned along the predetermined path of the metal sheet, but downstream from the first and second blast heads. One of the brushes abrades the cracked portion of the layer of scale on the top surface of the metal sheet to form a descaled top surface. A second one of the brushes abrades the cracked portion of the layer of scale on the bottom surface of the metal sheet to form a descaled bottom surface. The descaled top and bottom surfaces preferably have a surface roughness of 2.5 microns Ra or less, and preferably 1.5 microns Ra or less, and can be produced at rates in excess of 100 feet per minute.

In one aspect of the present invention, the media is non-metallic media and comprises a plurality of ceramic beads with a particle size within a range of 0.025 mm to 1.00 mm. More preferably, the ceramic beads have a particle size within a range of 0.07 mm to 0.14 mm. The non-metallic media can also comprise a plurality of glass beads which are lower in cost but tend to wear more quickly than ceramic beads.

In another aspect of the present invention, the blast nozzle is a fan shaped blast nozzle that has a durable inner coating made of ceramic that resists wear to the blast nozzle from the media as it is being sprayed. The fan shaped blast nozzle distributes the media in a fan shaped blast to maximize the area of the cracked scale surface.

In yet another aspect of the present invention, the brushes are rotating brushes and each brush has a plurality of radially extending metal bristles with a tip diameter of approximately 0.25 mm.

The present invention has several advantages. Hazardous acids, and other caustic substances, do not have to be used to produce a descaled surface. The surface produced is pH neutral and therefore resists additional corrosion and does not require oil coatings, or other protective treatments. The descaling apparatus can produce a metal surface with a roughness less than 2.5 microns Ra without stretching, polishing or cold-rolling. Eliminating these steps makes for a faster, more robust process and saves considerable cost. The descaling apparatus can process at line speeds in excess of 100 to 400 feet per minute, which is particularly advantageous for stainless steels that have a slow and difficult pickling process. Line stops can be performed without damaging the metal surface. The descaling apparatus can be easily restarted or switched to different types of metal without the need for excessive reconfiguration.

BRIEF DESCRIPTION OF THE DRAWINGS

Figures 1, 1A:
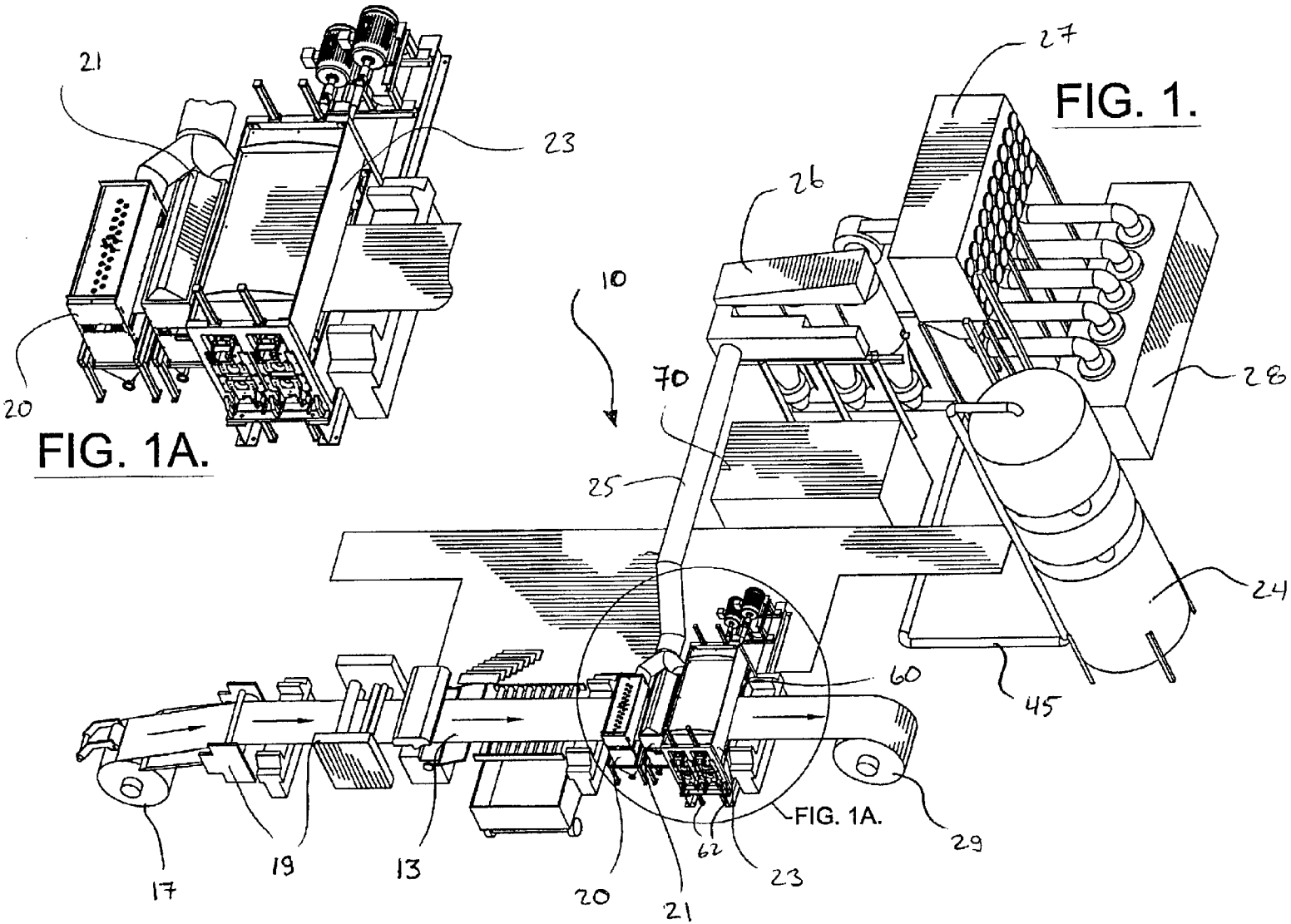
Figure 3:
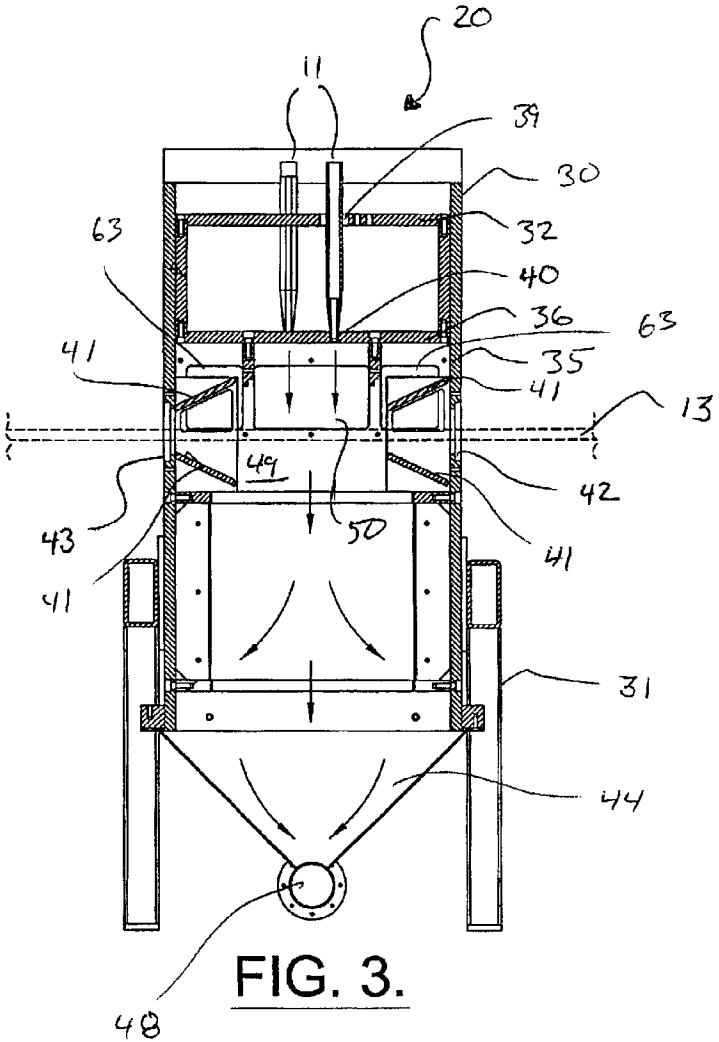
Figure 2:
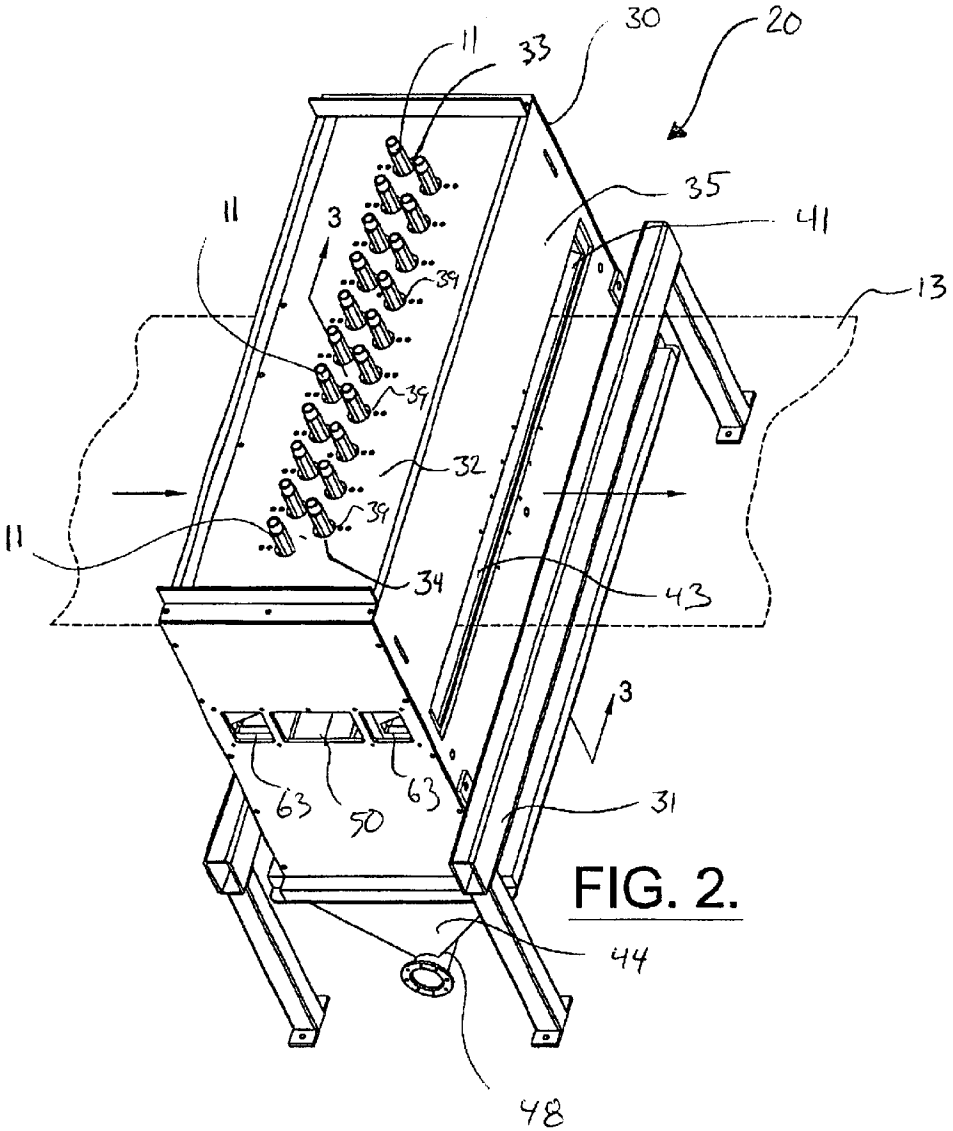
Figure 5:
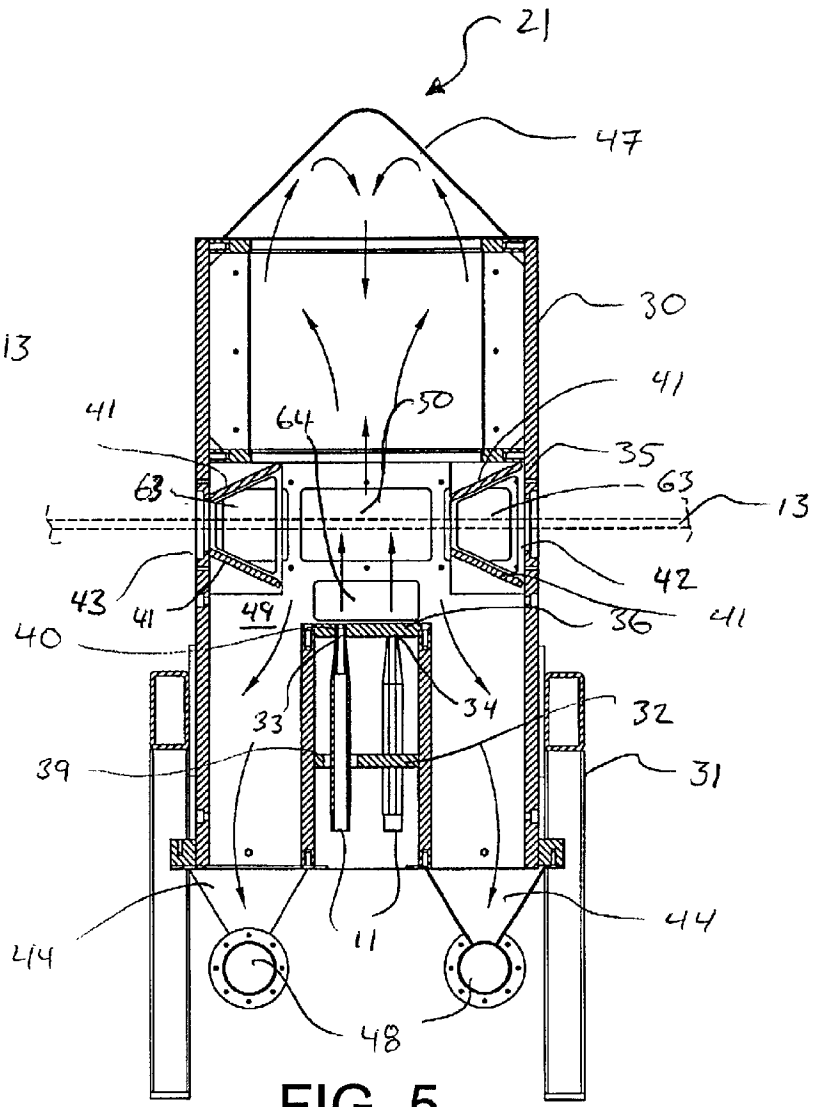
Figure 4:
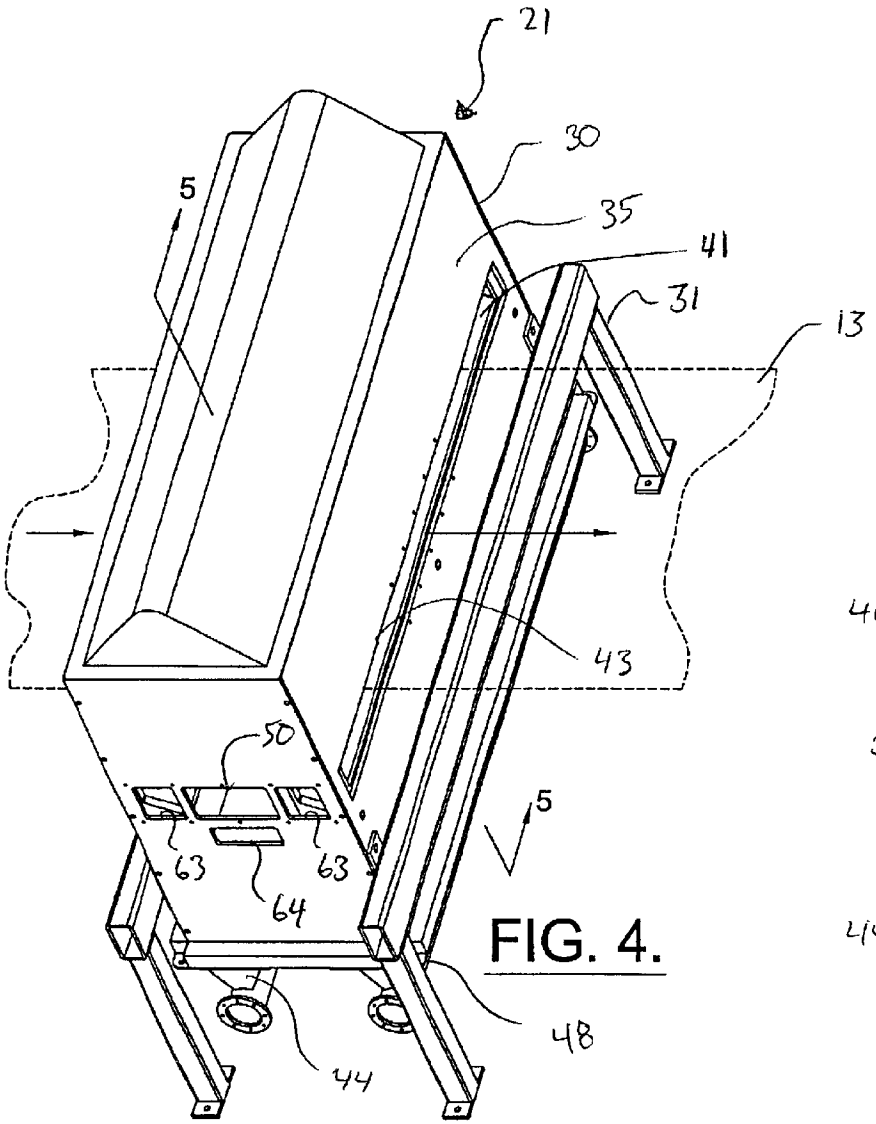
Figure 6:
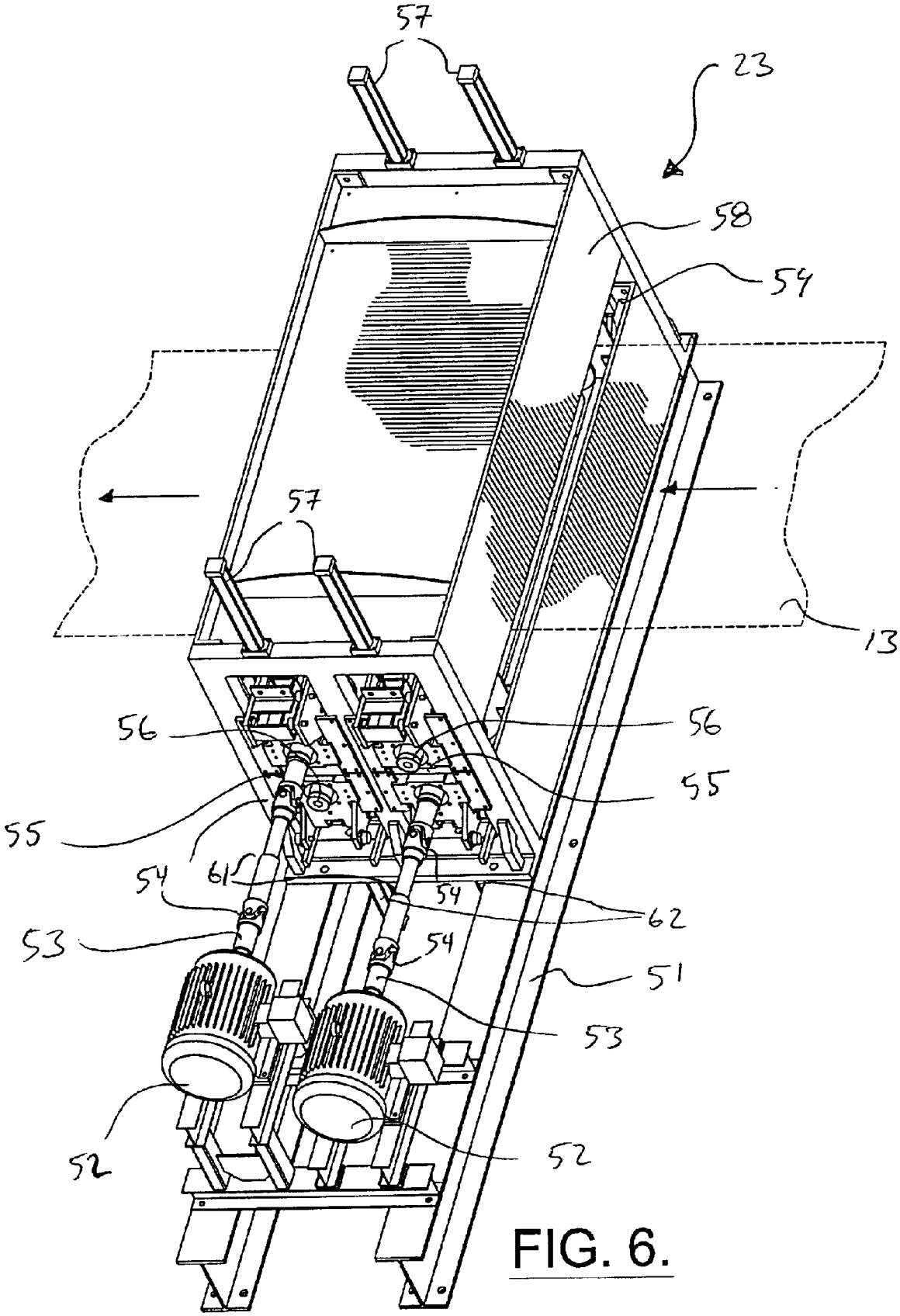
Figure 7:
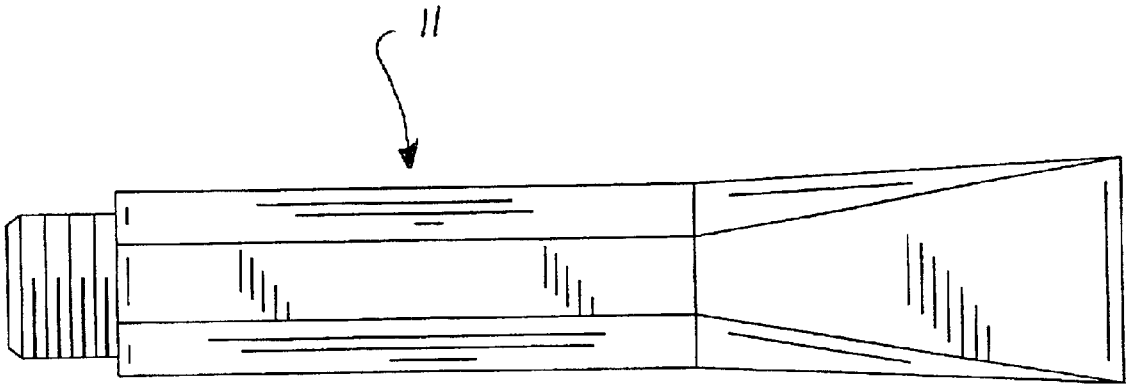

Having thus described the invention in general terms, reference will now be made to the accompanying drawings, which are not necessarily drawn to scale, and wherein:

FIG. 1 is a perspective view of the descaling apparatus of a first embodiment of the present invention;

FIG. 1A is a close-up, perspective view of a pair of blast heads and an abrading station of the descaling apparatus shown in FIG. 1;

FIG. 2 is a perspective view of a down-firing blast head of the descaling apparatus shown in FIG. 1;

FIG. 3 is a side elevation view of a partial cross-section of the down-firing blast head shown in FIG. 2;

FIG. 4 is a perspective view of an up-firing blast head of the descaling apparatus shown in FIG. 1;

FIG. 5 is a side elevation view of a partial cross-section of the up-firing blast head shown in FIG. 4;

FIG. 6 is a perspective view of the abrading station shown in FIG. 1; and FIG. 7 is a plan view of a fan shaped blast nozzle of a first embodiment of the present invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1 and 1A depict a preferred embodiment of a descaling apparatus 10 according to the present invention. FIGS. 1 and 1A illustrate the descaling of a metal sheet 13. However, other metal structures can be descaled by the application of the invention including metal strip, rod, wire and rod stock. The metal sheet is preferably comprised of hot rolled stainless steel. Various other types of metals can also be descaled by the current invention including, but not limited to, carbon steel, chromium alloyed steel, ferritic stainless steel, austenitic stainless steel, martensitic stainless steel, titanium, copper, brass and nickel.

The sheet of metal 13, having a layer of scale on its top and bottom surfaces, is advanced by a conveyor system 19 off of a roll 17 and into the descaling apparatus 10. The conveyor system 19 advances the metal sheet 13 at a speed from 100 to 800 feet per minute (fpm), preferably within a range of 200 to 400 fpm. As the sheet of metal 13 is advanced through the descaling apparatus 10 it passes through a first blast head 20, a second blast head 21 and an abrading station 23. The first and second blast heads 20 and 21 fire jets of ceramic beads at the top and bottom surfaces of the sheet of metal 13, respectively, and crack at least one scale layer. The abrading station 23 abrades away the cracked scale using a pair of brush assemblies 55 having stainless steel bristles. The descaled sheet of metal 13 is then wound on a finished roll 29 for further processing and/or distribution. The descaling apparatus 10 occupies only ¼ to 1/16 the floor space of conventional acid pickling lines that process the same steel sheet, strip, wire, or rod.

The conveyor system 19 is formed of a set of conventional roller assemblies that support and flatten the metal sheet 13 as it comes off of the roll and that guide the metal sheet into the blast heads. The conveyor system could be replaced with a range of different devices for unwinding the metal sheet and advancing it into the descaling apparatus 10. Other methods could also be used for different types of metal stock. The metal 13 could be leveled using the conveying system by applying enough tension to crack the scale before it is advanced through the descaling apparatus 10. Tension is applied to the metal sheet by advancing the finished roll 29 and braking the source roll 17. This is not a preferred step, however, as the present invention can still remove scale without tension leveling. Tension is applied to the metal sheet 13 to advance it through the apparatus 10, but the tension required to advance the metal sheet is 25%, or less, of the tension needed to pre-crack the scale.

As shown in FIGS. 2 through 5, each blast head 20, 21 includes a chamber 30 supported by a frame 31. The chamber 30 includes a box-like wall structure 35, a nozzle clamp plate 32, a nozzle alignment plate 36, an air exit plate 49 and a collector bin 44. The nozzle clamp plate 32 includes a plurality of apertures 39 for receiving and arranging a plurality of nozzles 11. In FIGS. 2 through 5, the nozzle clamp plate 32 includes a first row 33 and a second row 34, but any configuration of one or more rows can be used. The first row 33 of apertures when filly filled can contain eleven nozzles and the second row 34 when fully filled can contain ten nozzles as shown in FIGS. 2 through 5. This arrangement is preferred for a metal sheet 13 width of 50 inches to 60 inches. However, other nozzle arrangements can also be used in accordance with the present invention. The nozzles 11 are further secured and arranged by a plurality of apertures 40 in the nozzle alignment plate 36 that are in positions corresponding to the apertures 39 in the clamp plate 32. The apertures 40 are smaller than the apertures 39 and are shaped to restrict downward or upward movement of the nozzles 11.

The blast heads 20, 21 are compact and rugged devices requiring fewer moving parts than conventional devices and are designed to resist the wear and tear of constant operation. The supply lines, every part of the nozzles 11 except for their outlet ends, and various other fittings are kept outside of the chamber 30 to protect them from the flying media and dust caused by blasting. The ability to selectively start and stop air flow to the nozzles 11 reduces damage to the blast heads 20, 21 caused by blasting when no metal sheet 13 is present to absorb the energy of the moving media. The chamber 30 can be lined with a urethane rubber coating to absorb the reflected momentum of the media and reduce wear.

The nozzles 11 are arranged in proximity to the metal sheet 13 to provide adequate cracking of scale. For example, the nozzles can be preferably arranged 1 inch to 20 inches, and more preferably 3 inches to 12 inches, from the metal sheet. In the first embodiment, illustrated in FIGS. 2 through 5, the nozzles are arranged at a distance of 7 inches from the metal sheet. Suction nozzles generally require a shorter distance within a range of 1 inch to 6 inches. The arrangement of the nozzles at the top or bottom of the sheet of metal 13 and the velocity of the air across the sheet is high enough to keep media from building up in the blast head, but not so high as to interfere with the jets sprayed from the nozzles 11. Up and down-firing nozzle placement in separate blast heads 20, 21 avoids damage from media cross-fire and provides a longer deceleration zone for the media. A longer deceleration zone reduces wear on the chamber 30 and the media when the metal sheet 13 is absent or is more narrow than the rows 33, 34. Thus, metal sheet 13 narrower than the width of the rows 33, 34 can be run without turning the nozzles at the edges off.

The blast heads 20, 21 are also designed to minimize loss of media and dust to the outside environment. The wall structure 35 includes an inlet slot 42 with an inlet skirt (not shown) and an outlet slot 43 with an outlet skirt (not shown) to contain dust and ricocheting media from the jets. The continuously moving sheet of metal 13 moves through the blast head by entering the inlet slot 42 through the inlet skirt and exiting the outlet slot 43 through the outlet skirt. The skirts are preferably constructed of a compliant, durable material, such as rubber or dense brushes, that resiliently conform to the shape of the sheet of metal 13 to guard against media and dust escaping the chamber 30. A set of media ramps 41 positioned in proximity to the slots 42, 43 and protect the blast head 20, 21 from the free end of the metal sheet 13 as it is advanced off of a new roll 17 and through the blast head. The ramps 41 on the inlet side are angled to deflect the free end of the metal sheet (which may still be curled from roll storage) away from the nozzles 11 and on the outlet side direct the free end out of the blast head through the outlet slot 43.

The chamber 30 of each blast head 20, 21 is kept at a negative pressure by suction applied through a set of apertures including a main aperture 50, a pair of side apertures 63 and a bottom aperture 64 in the air exit plate 49. The suction pressure, combined with the small volume of the chamber 30, produces a high velocity side draft or sweep of air in the cross-machine direction through the main aperture 50 and over the top of the sheet of metal 13. The suction pressure applied through the bottom aperture 64 produces a side sweep of air under the metal sheet 13. Another side sweep of air flows through the pair of side apertures 63 and past the inlet and outlet slots 42 and 43. The side sweep of air and the negative pressure of the camber 30 further inhibit the escape of media and dust from the chamber. In addition, the negative pressure draws dust away through the air exit plate 49 and the media return duct to be filtered at a filter house 27.

The collector bin 44 at the bottom of the first blast head 20 has a funnel shape that captures falling media and dust. The collector bin 44 at the bottom of the second, up-firing blast head 21, has a double funnel shape. The pair of funnel shapes flanking the adjacent nozzle rows 33 and 34 forms an "M" shape for the blast head as seen from a side elevation view. The M shape of the second blast head 21 allows the ends of the nozzles 11 to be close to the metal sheet 13. The M shape also allows the nozzles 11 to be easily accessed from outside the chamber 30. The top of the second blast head 21 includes a deceleration shield 47 defining the deceleration zone that deflects and decelerates media in the absence of the sheet of metal 13. The shape each collector bin 44 directs the falling dust and media into a media outflow zone 48 and into a return duct 25 at the bottom of each bin.

Once in the media outflow zone 48, the media flows into the return ducts 25 to a media recovery station 26 that separates worn media and blasted scale from usable media. The media recovery station 26 includes three bins where a cyclone action separates the dust and spent/fractured media from the good media. Spent/fractured media, scale and dust are routed through the filter house 27 to filter dust particles and to dispense the spent media and scale into a waste media roll away bin 28. Unusable media that is too small or contaminated with surface scale can be returned to the manufacturer for regeneration into virgin media. This creates a closed-cycle manufacturing process free of undesirable byproducts. Usable media and additional new media from a fresh media bin 70 are routed through a transport duct 45 into the pressure pot 24. The pressure pot has two stages and includes a hopper of media. The hopper is above the first stage of the pressure pot and dumps media into the first stage, which is kept at a relatively low pressure. The first stage then closes off and drops the media and pressurized fluid into the second, high-pressure stage for full pressurization and outflow to the blast heads 20, 21.

The nozzles 11 at each blast head 20, 21 are positioned in proximity to the sheet of metal 13. The nozzles 11 of the first blast head 20 are positioned at the top of the blast head pointing downwards to spray the jet of ceramic beads onto the top surface of the sheet of metal 13. The nozzles 11 of the second blast head 21 are positioned at the bottom of the second blast head pointing upwards to spray the jet of ceramic beads onto the bottom surface of the sheet of metal 13. In this manner, all the scale can be removed from the sheet of metal 13 without having to turn the sheet over and rerun it through the descaling apparatus a second time. Not all of the apertures 39 and 40 have to be filled with a nozzle 11 for descaling to be performed. Fewer nozzles 11 could be used if narrower widths of metal sheet 13 are being descaled or less than the full width of a sheet is being descaled.

The size of the nozzles 11, spacing between nozzles, placement of the nozzles from the surface of the metal, air pressure feeding the nozzles and media size and shape are factors that affect the efficiency and effectiveness of the descaling process. Each nozzle 11 preferably is a pressure-blast fan nozzle as shown in FIG. 7 and suitable nozzles are commercially available from Pauli Systems, Inc., Fairfield, Calif. The fan shape allows each nozzle 11 to distribute a fan shaped jet of media that, in conjunction with the adjacent arrangement of the nozzles in the rows 33 and 34, provides full, overlapping coverage of metal sheets up to 60 inches in width. The nozzles 11 can be coated with a ceramic lining (not shown) to reduce wear from the media. The ceramic lining of each nozzle is preferably comprised of boron nitride, but can be comprised of other types of hardened coatings such as tungsten carbide. Additional coverage could be accorded to the descaling apparatus 10 by using additional rows of nozzles, or longer rows of nozzles for wider sheets of metal 13. As an alternative to the blast heads, although not preferred, the media could be accelerated with a rotating wheel obviating the need for a supply of air pressure.

Each nozzle 11 is supplied with a mix of pressurized air and ceramic beads through a supply line or hose (not shown) connected to a funnel extending off of a pressure pot 24. The supply lines for the first blast head 20 arc up over the blast head to connect to the nozzles 11. The supply lines for the second blast head 21 preferably are on, or near, the floor. However, the supply lines in general can travel any route from the pressure pot 24. A mixing valve (not shown) is positioned directly under each funnel extending off of the pressure pot 24 and introduces additional pressurized air that mixes with the media. The media and pressurized air mixture travels through the supply line to the nozzle 11. As it exits the nozzle 11, the media is accelerated by the pressurized air to a velocity within a range of 100 fpm to 800 fpm. Using lower speeds decreases wear on the apparatus 10 and reduces the tendency of the media to become embedded in the surface of the metal.

The air flow to the nozzles 11 can be turned on or off independently via a bank of electronic solenoid valves (not shown) above the first blast head 20 and below the second blast head 21. The solenoid valves allow the air flow to be stopped instantaneously. The air supply can also be ramped up or down, to tailor the treatment degree to the line speed and avoid leaving stop/start marks on the sheet 13. Air requirements are approximately 5000 cubic feet per minute (cfm) per blast head 20, 21 to treat a 53 inch width of metal sheet 13. A 15000 cfm compressor is used to allow treatment of a full 60 inch width and to provide a safety margin for piping losses. Electronic control of each of the nozzles 11 could allow the treatment width to be varied to accommodate varying widths and wander of the metal sheet 13 from side to side. Electronic control can also be used to selectively descale and mark or pattern the metal surface.

Arrangement of the nozzles 11 in rows allows for the use of media with different particle sizes to more effectively descale the metal and leave a smooth surface finish. For instance, the first row of blast heads 33 could use the largest particle size, the second row 34 the second largest, and so on, until a last row is reached having the smallest particle size. A cost efficient way of generating media with different particle sizes is to continuously recycle the media as it breaks down due to wear. For instance, the more coarse, virgin media can be allotted to the initial row of nozzles 11 and the worn media can be progressively allotted to subsequent rows the particle size decreases.

Suction nozzles can be used as a low cost alternative to the pressure-blast nozzles 11 discussed above. Air flowing through an inlet orifice generates a suction pressure across the suction nozzles via the venturi effect. The suction pressure accelerates the media out of a media storage chamber and through the suction nozzles. The placement of the up-firing and down-firing nozzles can be symmetrical and in the same chamber because the velocity of the media is low enough to reduce wear caused by a cross-fire. A larger number of nozzles are used as the effective size of the media jets are smaller than the pressure blast nozzles. These nozzles are mounted in a removable nozzle carriage that allows an entire nozzle group to be replaced at one time, which minimizes downtime. The slower velocity of the media generated by the suction nozzles makes the suction nozzles ideal for slower moving, narrow width metal sheet or strip. However, higher production speeds on wider metal sheet will typically require pressure-blast nozzles because the amount of media per cubic foot of air and the velocity of the media is greater. In yet another embodiment, the nozzles can be made in groups of five or ten, allowing for more selective replacement of smaller groups of worn nozzles.

The preferred media are smooth edged, nonmetallic particles, such as ceramic beads. Smooth edged media can crack and loosen the metal oxide layers at processing speeds of 200 fpm to 400 fpm, or even higher, depending upon the configuration of the nozzles and the mechanical characteristics of the particles. In addition, nonmetallic media does not tend to become embedded in the surface like metallic media can. Ceramic beads, e.g., zirconia/silica beads sold under the trademark B120 CERAPEEN from Pan Abrasives, Victoria, Australia, are the preferred media for most applications due to the durability and hardness of the ceramic. The average particle size of the ceramic beads is preferably 0.025 mm to 1.00 mm, and more preferably 0.07 mm to 0.14 mm. Glass beads, e.g., GB10 BRIGHTBLAST from Pan Abrasives, are a less expensive alternative and preferably have an average particle size that ranges (particle size) from 0.00111 inches to 0.0394 inches. Depending upon the type of media used, the particles can be recycled between 20 times and several thousand times. In general, the ceramic beads are much longer lasting than the glass beads and can be reused about 100 times longer than glass beads. The types and sizes of media can be varied depending upon the type of metal being descaled, the thickness of the scale, the velocity of the jets, cost constraints, etc.

As shown in FIG. 1, the abrading station is downstream of the blast heads 20, 21. As shown in FIG. 6 the abrading station includes a housing 58 and a pair of drive motors 52 resting on a base 51. The housing 58 defines an inlet slot 59 for entering sheet metal 13, and an outlet slot 60 for exiting sheet metal. The brush assemblies 55 are supported on top by a set of four hydraulic cylinders 57, e.g., Rexroth Pressuremaster HH 2½ inch bore×24 inch stroke, and the bottom of the brush assemblies are supported by a second set of four hydraulic cylinders 62, e.g., Rexroth Pressuremaster HH 2½ inch bore×18 inch stroke. The hydraulic cylinders actuate in response to changing sheet metal 13 height and thickness to jump waves in the sheet metal and to allow the brush assemblies to come up to speed as they drop onto the surface of the sheet metal. The two drive motors 52 are electric motors and are each attached to one end of an expanding drive shaft 53 that has a telescoping midsection 61 and a pair of U-joints 54 that allow the drive shaft to buckle and lengthen in response to actuation of the housing 58. The expanding drive shafts 53 also allow swing up of the top brushes to clear non-flat metal, such as when the head or tail of the metal sheet 13 is advanced through the apparatus 10. Other types of actuating devices can be used in place of the cylinders 57, 62, such as pneumatic cylinders or servo-mechanical cylinders.

The other end of each drive shaft 53 is attached to a brush assembly 55. Each brush assembly 55 preferably includes a cylindrical brush body mounted on a brush roll shaft that is attached to, and rotatably driven by, its corresponding drive shaft 53 and motor 52. For example, cylindrical brush bodies having a 14 inch diameter have been found useful in the present invention. Each brush assembly 55 cooperates with an adjacent one of the support rolls 56 to adjust the brush bite on the passing sheet metal 13 and achieve increased abrading effects. The brush assembly 55 adjacent to the inlet slot 59 is positioned to brush the bottom of the sheet metal 13, while the brush assembly adjacent the outlet slot 60 is positioned to brush the top of the sheet metal. This configuration could be varied and still achieve the same abrading effect. In addition, the abrading station could include additional brush assemblies for faster or more thorough abrading. The top of the housing 58 swings up to allow easy servicing for the top and bottom brush assemblies 55.

The brush of the brush assemblies 55 is preferably a cylindrical brush with radially extending bristles constructed of stainless steel of suitable tip diameter and length, e.g., having a wire tip diameter of approximately 0.01 inches and a length of about 2 inches. The preferred rotational speed for the brushes is in a range of 1000 to 4000 rpm. Abrading can also be performed by other devices such as plastic brushes or pads with embedded abrasives.

During the descaling process, the nozzle 11 sprays the jet of ceramic beads onto the continuously moving sheet of metal 13. In a preferred embodiment of the invention wherein stainless steel is used, the sheet of metal 13 has a base with the layer of scale that generally comprises three sublayers, an upper hematite ($Fe_2O_3$) layer farthest from the metal surface, an intermediate magnetite ($Fe_3O_4$) layer, and a lower wustite (FeO) layer adjacent to the metal surface. Scale as herein defined also includes other types of oxidation layers, soot and other debris that forms on the surface of a metal during or after production is completed. As the sheet (or strip) of metal 13 is advanced past the nozzle 11 the scale layer is cracked and can be partially removed by a high velocity jet of ceramic beads dispensed from the blast head. The hematite and magnetite sublayers are brittle and are most likely to be removed by the jet of ceramic beads. The sheet of metal 13 is advanced downstream to the stainless steel brush rolls that abrade the top and bottom of the sheet until the remaining scale is removed to reveal the base underneath.

Metal descaled by the present invention has a number of advantageous properites. The descaled sheet of metal 13 has a low surface roughness of 1.5 microns Ra or less making it suitable for a majority of applications and therefore does not require additional polishing. The descaled sheet of metal 13 is pH neutral allowing it to resist further oxidation without oil or other surface treatments. Carbon steel surfaces that are pH neutral are especially resistant to corrosion and reformation of the oxide scale. Also, the cleaned surface of the metal is sufficiently smooth to be used in lieu of more costly cold rolled steel for many applications and is suitable for immediate glavanizing. The descaled metal produced by the present invention has a SEM/EDS percent residual surface oxygen measurement of less than 4%, and more preferably less than 2%. SEM/EDS measurements reveal the elemental composition of a sample using a detector that produces pulses that are proportional in energy and number to the x-rays that are emitted by the sample. This electron generated radiation can be correlated to specific elements such as, in this case, the oxygen on the metal surface. The descaled metal produced by the present invention also has a residual surface particle content ranging from 0.1% to 1%.

Without being tied to any particular theory, it is believed that the spray of smooth edged particles primarily cracks and weakens the outer layers of oxide. In stainless steel, the outer layer is comprised of magnetite and hematite which are cracked and weakened. Each particle shatters or cracks an area many times the size of the particle and the smooth edges of the particles lower the tendency of the particle to embed itself in the steel surface. Shattering has the effect of breaking up and removing the brittle and hard outer layers of oxide and exposing the softer inner layers to abrasive brushing. In addition, the smooth edged particles leave the underlying surface and remaining oxide (the wustite layer in stainless steel) surprisingly nascent and particularly vulnerable to subsequent abrading.

The resilient and soft inner oxide layer is especially resistant to attack by the impingement of high velocity particle streams, but once exposed can be abraded off the surface with relative ease and low cost. Abrading removes any of the weakened hard and brittle scale layers that remains after blasting. Abrading also removes the relatively soft, exposed inner layer of oxide and any of the smooth edged media that may have become embedded into the surface of the metal.

When used alone, mechanical abrading is generally ineffective at descaling metal strip or sheet. Merely brushing the same strip at the same speed has no discernable effect on the black scale. Even slowing the advancing sheet to speeds as slow as 2 fpm results in little improvement. Yet, when used in concert with the smooth edged media sprayed in a high-velocity particle stream at the metal surface, it leaves the metal surface as clean and smooth as acid descaling without the use of hazardous materials associated with hazardous descaling.

Media blasting alone at metal sheet speeds of 200 fpm, or as low as 5 or 10 fpm, is also less effective than the combination of blasting and abrading, leaving the metal sheet 13 a dull gray with streaks of black scale. Increasing the intensity of the media blasting and/or slowing the processing speed results in little improvement in the amount of scale removed and tends to leave more particles embedded in the metal surface. Therefore, the combination of a smooth edged particle attack followed by surface abrading is ideal for achieving a clean, smooth metal surface at economical processing speeds.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A continuous method of descaling a layer of scale on an advancing metal surface without the use of caustic materials, said method comprising:

advancing a metal surface along a predetermined path of travel;

cracking the layer of scale by spraying media under fluid pressure at the surface of advancing metal; and abrading the cracked layer of scale to remove the scale thereby forming a descaled metal surface.

2. The method of descaling of claim 1, wherein said abrading step comprises abrading the metal surface to produce a metal surface having a roughness of less than 2.5 microns Ra.

3. The method of descaling of claim 1, wherein said abrading step comprises abrading the metal surface to produce a metal surface having a roughness of less than 1.5 microns Ra.

4. The method of descaling of claim 1, wherein said advancing step advances the metal surface at a speed of at least 100 feet per minute.

5. The method of descaling of claim 1, wherein said advancing step advances the metal surface at a speed of at least 400 feet per minute.

6. The method of descaling of claim 1, wherein said cracking step comprises spraying ceramic beads at the metal surface.

7. The method of descaling of claim 6, wherein said cracking step comprises spraying ceramic beads at the metal surface having a mean particle diameter within a range of 0.025 mm to 1 mm.

8. The method of descaling of claim 6, wherein said cracking step comprises spraying ceramic beads at the metal surface having a mean particle diameter within a range of 0.07 mm to 0.14 mm.

9. The method of descaling of claim 1, wherein said cracking step comprises spraying glass beads at the metal surface.

10. The method of descaling of claim 1, wherein said abrading step comprises brushing the metal surface.

11. The method of descaling of claim 1, wherein said cracking step comprises spraying a fan shaped jet of said media.

12. The method of descaling of claim 11, wherein said cracking step comprises spraying said media across an entire width of the advancing metal surface.

13. The method of descaling of claim 1, wherein said advancing step comprises advancing a substantially continuous metal surface along a predetermined path of travel.

14. The method of descaling of claim 13, wherein said advancing step comprises advancing any one of a group of metal surfaces consisting of strip, sheet, bar, wire and rod stock.

15. The method of descaling of claim 1, wherein said advancing step comprises advancing a metal surface comprising any one of a group of metals consisting of carbon steel, chromium alloyed steel, ferritic stainless steel, austenitic stainless steel, martensitic stainless steel, titanium, copper, brass and nickel.

16. The method of descaling of claim 1, wherein said cracking step comprises down-firing said media at a top surface of the metal.

17. The method of descaling of claim 1, wherein said cracking step comprises additionally up-firing said media at a bottom surface of the metal.

18. The method of descaling of claim 1, wherein said cracking step comprises up-firing said media at a bottom surface of the metal.

19. The method of descaling of claim 1, wherein said cracking step comprises spraying media at a top and a bottom surface of said metal.

20. The method of descaling of claim 1, wherein said abrading step comprises abrading said top surface and said bottom surface of said metal.

21. The method of descaling of claim 1, further comprising the step of recycling the media from said cracking step.

22. Descaled metal produced by the method of claim 1, having a surface roughness of less than 2.5 microns.

23. Descaled metal produced by the method of claim 1, having a surface roughness of less than 1.5 microns.

24. Descaled metal produced by the method of claim 1, having SEM/EDS percent residual surface oxygen measurement of less than 4%.

25. Descaled metal produced by the method of claim 1, having a residual surface particle content of from 0.1% to 1%.

26. Descaled metal produced by the method of claim 1, having a surface pH of 7 or above.

27. Descaled metal produced by the method of claim 1, said metal selected from one of a group consisting of hot rolled stainless steel, hot rolled carbon steel, low carbon steel, ferritic stainless steel, austenitic stainless steel, martensitic stainless steel, titanium, copper, nickel and brass.

28. Descaled metal produced by the method of claim 1, said metal selected from any one of a group of metal surfaces consisting of strip, sheet, bar, wire and rod stock.

* * * * *